United States Patent [19]

Brock

[11] 4,031,649

[45] June 28, 1977

[54] AUTOMATIC SAFETY LOCK FOR FIREARMS

[76] Inventor: Walter B. Brock, 1101 Titus Towers, Ithaca, N.Y. 14850

[22] Filed: July 23, 1976

[21] Appl. No.: 707,934

[52] U.S. Cl. ..... 42/70 F; 42/70 E

[51] Int. Cl.[2] ..... F41C 17/04; F41C 17/02

[58] Field of Search ..... 42/70 R, 70 E, 70 F, 42/69 R, 69 A

[56] References Cited

UNITED STATES PATENTS

| | | | |
|---|---|---|---|
| 313,170 | 3/1885 | Bull | 42/70 E |
| 465,764 | 12/1891 | Jenkins | 42/70 E |
| 712,282 | 10/1902 | Fay et al. | 42/70 F |
| 1,110,837 | 9/1914 | Swebilius et al. | 42/70 E |
| 1,290,292 | 1/1919 | Morrison | 42/70 F |
| 2,484,928 | 10/1949 | Boone | 42/70 E |
| 2,914,877 | 12/1959 | Willenbacher | 42/70 E |

FOREIGN PATENTS OR APPLICATIONS

| | | | |
|---|---|---|---|
| 595,523 | 7/1925 | France | 42/70 E |

*Primary Examiner*—Charles T. Jordan
*Attorney, Agent, or Firm*—Shlesinger, Fitzsimmons & Shlesinger

[57] ABSTRACT

A spring-loaded safety button is mounted in an opening in the forward end of a gun stock so that it will naturally fall beneath and be depressed by, the thumb on the trigger hand of the person firing the gun. In one embodiment the button registers with the rear end of a pivotal lever, the forward end of which has thereon a hook which normally engages the rim of the firing pin to prevent the gun from being fired until the button is depressed to swing the lever in a direction to disengage the hook from the firing pin. In a second embodiment the button has a shank which extends slidably downwardly behind the trigger of the gun. A projection on the shank normally engages the rear of the trigger to prevent it from being operated, but when the button is depressed the projection registers with a notch in the back of the trigger to allow the latter to be pivoted to fire the gun.

2 Claims, 2 Drawing Figures

AUTOMATIC SAFETY LOCK FOR FIREARMS

Figure 1:
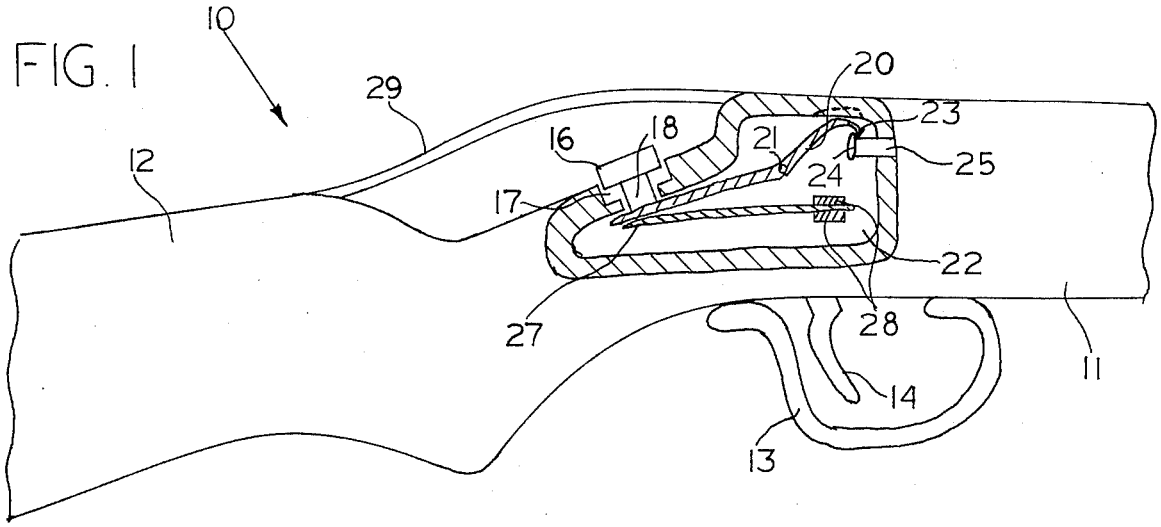

This invention relates to firearms, and more particularly to an improved, automatic safety device for preventing accidental firing of a rifle or the like.

Most guns or firearms are provided with locking mechanisms which are intended to prevent accidents. But hunters sometimes forget to use them, just as motorists sometimes forget to buckle their seat belts or safety belts. Because of the cumbersome nature of standard devices, hunters are tempted to "forget" to utilize the safety on a hunting rifle, for example. Often this is because the safety device must be manually unlocked, thereby causing a split second delay which may cause the hunter to miss his or her target and to come home empty-handed and disappointed.

It is an object of this invention, therefore, to provide for firearms an improved, automatic safety lock the operation of which cannot be overlooked or forgotten.

Still another object of this inventin is to provide an improved safety device which operates automatically to lock the firing pin of a gun when the hunter takes his or her hand off of the trigger.

A further object of this invention is to provide an improved firearms safety device which automatically locks itself when the hunter takes his or her hand off the trigger, and which also is instantly ready to fire when the gun is aimed and its trigger squeezed.

Other objects of the invention will be apparent hereinafter from the specification and from the recital of the appended claims, particularly when read in conjuction with the accompanying drawing.

Figure 2:
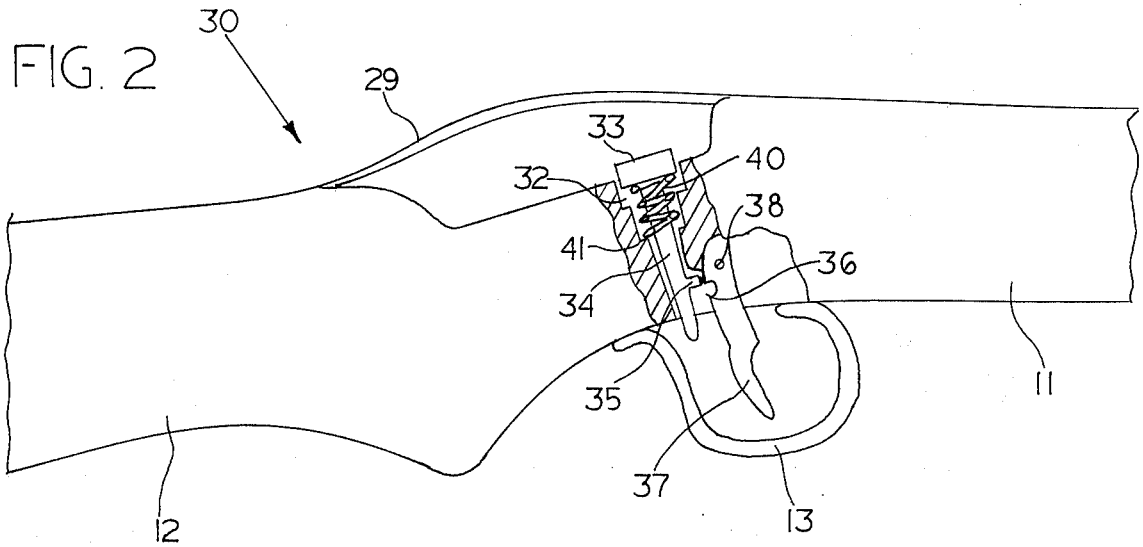

In the drawing;

FIG. 1 is a fragmentary side elevational view of a gun having therein an automatic safety lock made according to one embodiment of this invention, portions of the gun being cut away and being shown in section for purposes of illustration; and FIG. 2 is a fragmentary side elevational view of a gun having incorporated therein an automatic saftey lock made according to a second embodiment of this invention, portions of this second gun being cut away and shown in section for purposes of illustration.

Referring now to the drawing by numerals of reference, and first to FIG. 1, 10 denotes generally a gun comprising a forward, handgrip portion 11, and the usual stock portion 12 projecting rearwardly from the handgrip portion 11. Numeral 13 denotes a conventional trigger guard which is fastened to the underside of the gun to surround and protect the trigger 14, which is adapted to be pivoted in known manner to operate the gun.

A safety button 16 is mounted for reciprocation in a recess or circular opening 17, which is formed in the top of the stock 12 adjacent its forward end where the operator's thumb normally rests when the gun is being fired. On its inner end the button 16 has a shank 18 which is seated against the rear end of a pivotal lever or safety catch 20, which is mounted intermediate its ends to pivot about a pin 21 in a recess 22, which is formed in the stock rearwardly of the hand grip portion 11. The opposite or forward end (the right end in FIG. 1) of lever 22 has thereon a hook 23, which is engageable over the rim 24 of the firing pin 25 of the gun when the pin is in its inactive position as shown in FIG. 1. Lever 20 is urged clockwise in FIG. 1 about the pin 21 by a leaf spring 27, which is secured at one end between a pair of abutments 28 in recess 22, and which is engaged at its opposite end with the underside of lever 20 adjacent its rear (left) end.

When the operator's hand is removed from the gun and the trigger 14, the safety button 16 is urged upwardly by the spring 27, which also urges the lever 20 into its clockwise position, as shown in FIG. 1, wherein the hook 23 engages over the rim 24 of the firing pin 25 to prevent the pin from being advanced to its firing position. However, when the operator puts his or her finger on the trigger 14, his or her thumb simultaneously falls upon and depresses the safety button 16 downwardly against the resistance of spring 27, thereby at the same time pivoting the lever 20 counterclockwise about pin 21 so that its hook 23 is disengaged from the rim 24 of the firing pin 25. This releases pin 25 so that it can be advanced in any conventional manner to its firing position in which it effects the discharge of a projectile from the gun upon operation of the trigger 14. Thereafer when the operator releases the trigger 14 and removes his or her hand from the gun and the button 16, the spring 27 returns the lever 20 to its safety position as shown in FIG. 1. Since it forms no part of this invention, the mechanism for operating the firing pin, when the trigger 14 is squeezed, has not been illustrated and described hererin.

As a further safety feature a metal strap or guard 29 is second to the top of the gun across the recess in which the button 16 is mounted so that the strap 29 prevents any accidental depression of the button 16, for example, as might occur if the gun were to be accidentally dropped, or if a branch of a tree were to brush against the top of the gun in the area of the safety button 16.

Referring now to the embodiment shown in FIG. 2, wherein like numerals are employed to denote elements similar to those employed in the first embodiment, 30 denotes generally a modified gun having the usual hand grip portion 11 and the stock 12. Mounted beneath the safety strap 29 to reciprocate in a vertical opening at 32 in the forward end of the stock 12 is a reciprocable safety button 33. Button 33 has an integral, downwardly extending shank 34 which is slidable in the opening 32. Adjacent its lower end shank 34 has thereon a small, laterally projecting lug 35, which is engageable in a recess 36 formed in the rear of a trigger 37 that is mounted forwardly of shank 34 for pivotal movement about a pin 38. A coiled compression spring 40, which surrounds the shank 34 between the head of pin 33 and a circumferential shoulder 41 which is formed in the opening 32 intermediate its ends, normally urges the button 33 upwardly into the position as shown in FIG. 2, wherein the lug 35 is seated against the rear surface of trigger 37 above the recess 36. In this position the lug 35 prevents the trigger from being pivoted to its firing position.

However, when the operator's hand is placed on the gun in order to operate the trigger 37, his or her thumb naturally falls upon and depresses the safety button 33 downwardly in the opening 32 until the lug 35 registers with the notch 36 in the rear of the trigger 37. This enables the trigger to be pivoted clockwise about the pin 38 far enough to effect the firing of the gun in any standard fashion. During the movement, of course, the recess 36 swings over the now-registering lug 35 on the shank 34.

As soon as the operator releases the trigger 37 it is swung backwardly in a conventional manner by a spring (not illustrated), thereby releasing the lug 35 from the recess 36 so that the spring 40 may urge the button 33 upwardly to its "safety" position as shown in FIG. 2. The gun is now set once again for operation in the manner noted above.

From the foregoing it will be apparent that applicant has devised a relatively simple, inexpensive and reliable means for preventing accidental operation of a firearm. The safety devices disclosed herein are designed to operate automatically by the operator's thumb, as soon as the operator grasps the gun and places his or her finger on the associated trigger. The spring means, which normally retains each device in one or the other of its two limit positions, also can be readily overcome by slight thumb pressure on the button 16 or 33. Furthermore, each gun is made doubly safe by incorporating an additional safety strap 29, which overlies the safety button 16 or 33 to prevent accidental depression of the button and consequent release of the associated safety mechanism.

While this invention has been described in detail in connection with only two embodiments thereof, it will be apparent that this application is intended to cover any such modifications of the invention which fall within the scope of one skilled in the art or the appended claims.

Having thus described my invention, what I claim is:

1. In a firearm having a hand grip portion and a gun stock projecting rearwardly therefrom, an automatic safety lock comprising a button mounted to reciprocate in an opening in said stock adjacent the forward end thereof, and positioned to register with the underside of the thumb on the underside of the thumb on the trigger hand of the operator of the firearm, an operating member on said firearm movable from an inactive to a firing position to effect the discharge of a projectile from the firearm, movable locking means interposed between said button and said operating member normally to hold said operating member releasably in its inactive position, and resilient means urging said button and said locking means into first positions in which said button projects from said opening in said stock and said locking means is engaged with said operating member releasably to hold it in its inactive position, said button being operative, upon being moved downwardly in said opening by the operator's thumb, to move said locking means to a second position against the resistance of said resilient means, thereby to release said operating member for movement to its firing position, said locking means being a lever pivoted intermediate its ends for movement by said button from said first position, in which one end of said lever is engaged with said operating member to hold the latter in its inactive position, to a second position in which said one end of the lever is disengaged from said operating member, said operating member being a reciprocable firing pin, having a circumferential flange forming a rim on one end thereof, and said lever having a hook on said one end thereof engageable over said rim to hold said pin in its inactive position when said button is in its first position.

2. A firearm as defined in claim 1, wherein the inner end of said button is engaged with the opposite end of said lever, and said resilient means comprises a leaf spring fixed at one end in said firearm and having its opposite end urged resiliently against said opposite end of said lever at the side thereof opposite said button.

* * * * *